United States Patent [19]

Vogt

[11] Patent Number: 4,475,683

[45] Date of Patent: Oct. 9, 1984

[54] RESEALABLE CLOSURE ASSEMBLY FOR A CONTAINER

[76] Inventor: Kuno J. Vogt, 4250 1/2 Fairmount Ave., San Diego, Calif. 92105

[21] Appl. No.: 429,101

[22] Filed: Sep. 30, 1982

[51] Int. Cl.[3] ..... B65D 39/16

[52] U.S. Cl. ..... 229/7 R; 222/541; 222/544; 229/17 R

[58] Field of Search ..... 229/7 R, 17 R, 43, 45 R; 222/421, 460, 528, 531, 538, 541, 544; 221/306

[56] References Cited

U.S. PATENT DOCUMENTS

| | | | |
|---|---|---|---|
| 1,478,355 | 12/1923 | Peterson | 229/7 R |
| 1,911,671 | 5/1933 | Blaunelt | 229/7 R |
| 1,945,612 | 2/1934 | Lacher | 222/544 |
| 2,188,191 | 1/1940 | Roos | 222/544 |

FOREIGN PATENT DOCUMENTS

| | | | |
|---|---|---|---|
| 153652 | 6/1932 | Switzerland | 229/7 R |

*Primary Examiner*—William I. Price
*Assistant Examiner*—Gary E. Elkins
*Attorney, Agent, or Firm*—Charles C. Logan, II

[57] ABSTRACT

A resealable closure assembly for a container having a tubular shaped body and a bottom wall closing its lower end. A neck portion has its lower edge connected to the top edge of the tubular shaped body and the neck portion is wider at its bottom than at its top. The resealable closure assembly is connected to the top end of the neck portion and it has a tubular pouring spout having a fold edge formed along its lower edge where it is connected to the top edge of the neck portion. The pouring spout is laterally collapsible upon its self and then foldable downwardly about the folding edge. A variety of inverted V-shaped clip securing members can be used for capturing the top end of the pouring spout when it is in its collapsed folded over state. In another embodiment of the invention a novel key member has cooperating structure through which the pouring spout can be inserted when in its collapsed state.

8 Claims, 16 Drawing Figures

RESEALABLE CLOSURE ASSEMBLY FOR A CONTAINER

BACKGROUND OF THE INVENTION

The invention relates to a closure assembly and more specifically a resealable closure assembly for a container.

In the past a variety of resealable closure assemblies have been known. Most of these resealable closure assemblies have one or more disadvantages and there has been a continual search for a better resealable closure assembly. Quite often a person will open a container and not wish to use or consume the entire contents at that time. A large number of these containers have no structure for resealing the closure.

It is an object of the invention to provide a novel resealable closure assembly that is economical to manufacture.

It is also an object of the invention to provide a novel resealable closure assembly for a container that is easy to open and close.

It is also an object of the invention to provide a novel resealable closure assembly that can be used with a plastic container.

SUMMARY OF THE INVENTION

Applicant's novel resealable closure assembly will be described in its preferred embodiment which would be in use with a one-piece injection-blow moldable plastic container. It is to be understood that the resealable closure assembly could also be used with containers made from different material and also in different forms than those illustrated in the drawings.

The resealable closure assembly is used with a tubular shaped member that forms the body of the container. A bottom wall closes the lower end of the tubular shaped member. Attached to the top edge of the tubular shaped member is a neck portion that is wider at its bottom than at its top. The resealable closure assembly is connected to the top end of the neck portion and it has a tubular pouring spout having a fold edge formed along its lower edge where it is connected to the top edge of the neck portion. The pouring spout is laterally collapsible upon itself and then foldable downwardly about the folding edge. One variation of the structure that can be used for securing the pouring spout in its collapsed state is a simple extrusion molded inverted V-shaped clip, with a catch-lip on the inside, to close the container. The clip securing member is pushed on to the folded pouring spout. The top edge of the pouring spout engages the catch-lip inside the inverted V-shaped clip, thus holding the clip down and the closure tightly closed. The clip securing member slides off laterally for opening of the container.

Variations of the V-shaped clip securing member have closed ends on them and these create a tamper-evident closure. Removal of the clips is achieved by a tear-open end tab, a side tab, or by splitting both ends. All of the inverted V-shaped clips illustrated in the application, with the exception of the end-split model, can be used to reseal the container.

An alternative embodiment of a resealable closure assembly is also illustrated in the drawings and this one has a key member to keep the container open and closed. The key member is preferably make of a fairly stiff plastic. The flatened pouring spout is pushed through a slot in the key member, past the side protrusions on the pouring spout, then the key is bent over the top, and an aperture in the key member is snapped onto the boss-shaped protrusion on the slanted side of the neck portion of the container. The narrow side of the key, next to the slot, is wedged under the fold for a very tight seal. To open the closure, the key member is bent over the top and rotated 90 degrees around the containers neck portion. This action forces the key-slot into a rectangular shape and with it the pouring spout. The key member stays on the container and it can be used for repeated resealing.

DESCRIPTION OF THE PREFERRED EMBODIMENT

Figure 1:
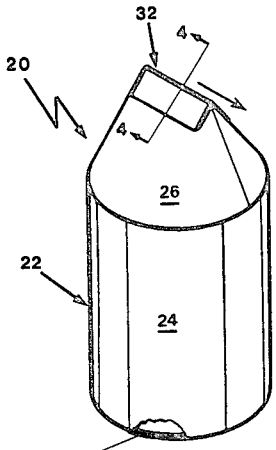
FIG. 1 is a perspective view of a container illustrating the novel resealable closure assembly.
Figure 2:
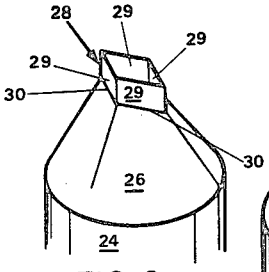
FIG. 2 is a perspective view of the novel resealable closure assembly in its open state.
Figure 3:
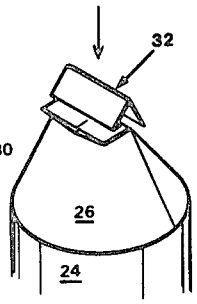
FIG. 3 is a perspective view of the novel resealable closure assembly in its intermediate stage of its closure.
Figure 4:
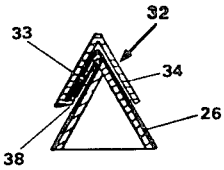
FIG. 4 is a cross sectional view taken along the lines 4—4 of FIG. 1.
Figure 5:
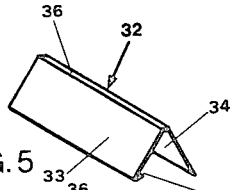
FIG. 5 is a perspective view of the inverted V-shaped clip securing member.

The novel resealable closure assembly for a container will be described by referring to FIGS. 1–5. The container is generally designated numeral 20 and it has a body 22 formed from a tubular member 24, a bottom wall 25, and a neck portion 26. A pouring spout 28 is formed of a plurality of panels 29 and it has a fold edge 30 formed along its lower edge where it is connected to the top edge of neck portion 26. An inverted V-shaped clip securing member 32 captures the top end of pouring spout 28 when it is in its collapsed folded over state.

Inverted V-shaped clip securing member 32 has a pair of laterally extending side panels 33 and 34 that are connected at their top along an apex edge 36. The bottom edge of side panel 33 has an inwardly extending catch lip 38 that traps the top edge of the pouring spout 28.

Figure 6:
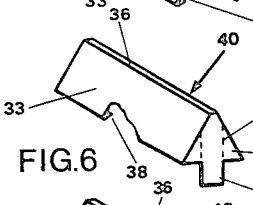
FIG. 6 is a perspective view of a first alternative inverted V-shaped clip securing member.

A variety of inverted V-shaped clip securing members are illustrated in FIGS. 6–12. In FIG. 6 the securing member 40 has end panels 41. A tab 42 extends downwardly from the bottom of the end panels 40 and weakened tear lines 43 are formed on the end panels.

Figure 9:
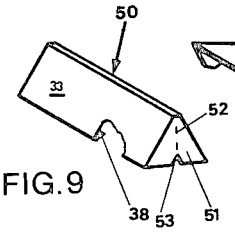
FIG. 9 is a perspective view of a fourth alternative inverted V-shaped clip securing member.
Figure 10:
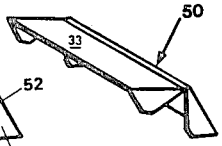
FIG. 10 is a perspective view of the securing member illustrated in FIG. 9 in its open state.
Figure 7:
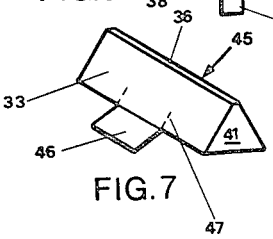
FIG. 7 is a perspective view of a second alternative inverted V-shaped clip securing member.
Figure 8:
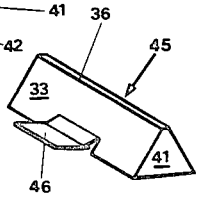
FIG. 8 is a perspective view of the securing member illustrated in FIG. 7 in its open state.

A securing member 45 is illustrated in FIGS. 7 & 8 in its closed and open state. It has a tab 46 extending from one of the side panels 33 and also has weakened tear lines 47. Another alternative securing member 50 is illustrated in FIGS. 9 & 10 in its closed and open state. Its end panels 51 have a weakened tear line 52 and a notch 53 is located at the bottom of the tear line.

Figure 11:
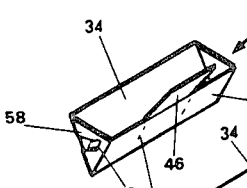
FIGS. 11 and 12 illustrate a fourth alternative inverted V-shaped clip securing member in both its closed and open states.
Figure 12:
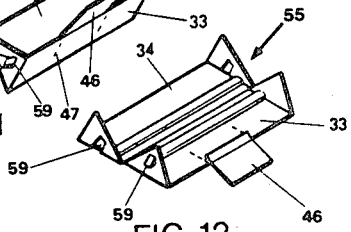
Figure 13:
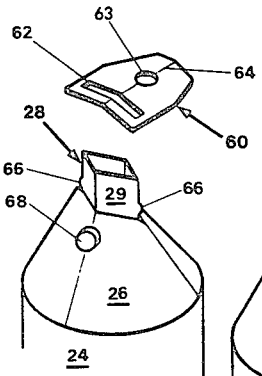
FIGS. 13–16 illustrate an alternative novel resealable closure assembly utilizing a key member and the manner in which it is used.
Figure 14:
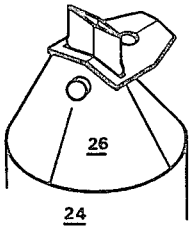
Figure 15:
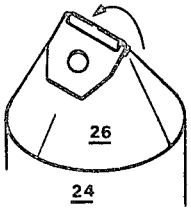
Figure 16:
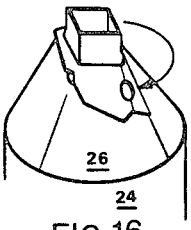

A further alternative securing member 55 is illustrated in FIGS. 11 and 12 in its closed and open state. It has end panels 57 with fastening structure 59 for securing the end panels together in their closed state.

In FIGS. 13–16 is illustrated basically the same container top as previously described and illustrated and a further alternative securing member 60 is used with this embodiment. Element 60 is a key member having a laterally extending slot 62, an aperture 63, and a fold line 64. The pouring spout 28 has its panels 25 modified by the application of protrusions 66 thereto. A boss-shaped protrusion 68 extends outwardly from neck portion 26. The manner in which key members 60 operates to open and close the container has been previously described in the summary of the invention.

What is claimed is:

1. A container comprising:

a tubular shaped member that forms the body of a container;

a bottom wall closing the lower end of the tubular shaped member;

a neck portion having its lower edge connected to the top edge of said tubular shaped member, said neck portion being wider at its bottom than at its top;

a resealable closure assembly connected to the top end of said neck portion comprising:

a tubular pouring spout having a fold edge formed along its lower edge where it is connected to the top edge of said neck portion, said pouring spout being laterally collapsible upon itself and then foldable downwardly about said folding edge, said pouring spout having at least four longitudinally extending fold edges that aid in collapsing said pouring spout, two of said longitudinally extending fold edges having a protrusion extending from them adjacent their lower ends (that function to aid in capturing said means for securing the pouring spout in a collapsed state); and means for securing the pouring spout in a collapsed state comprising a key member in the form of a substantially flat strip of plastic material, said member having a transversely extending slot through which said spout can be inserted when in its collapsed state, said protrusions on two of said longitudinally extending fold edges function to aid in capturing said means for securing the pouring spout in a collapsed state.

2. A container as recited in claim 1 wherein said neck portion has a boss-shaped protrusion and said key member has an aperture substantially the same size as said boss-shaped protrusion and into which said protrusion can be snapped in order to hold said pouring spout in a closed state.

3. A container comprising:

a tubular shaped member that forms the body of a container;

a bottom wall closing the lower end of the tubular shaped member;

a neck portion having its lower edge connected to the top edge of said tubular shaped member, said neck portion being wider at its bottom than at its top;

a resealable closure assembly connected to the top end of said neck portion comprising a tubular pouring spout being laterally collapsible upon itself and then foldable laterally downwardly; and means for securing the pouring spout in a collapsed state comprising an inverted V-shaped clip securing member having two side panels connected together along a common apex edge, one of said side panels having a catch lip along its lower edge for capturing the top end of said pouring spout when it is in its collapsed folded over state.

4. A container as recited in claim 3 wherein said inverted V-shaped clip securing member also has end panels connected across its opposite longitudinal ends.

5. A container as recited in claim 4 wherein at least one of said end panels has a tab extending downwardly from its lower end and said end panel also has weakened tear lines formed above said tab.

6. A container as recited in claim 4 wherein at least one of said side panels has a tab extending downwardly from its lower edge and said side panel also has weakened tear lines formed above said tab.

7. A container as recited in claim 4 wherein said end panels have weakened tear lines extending upwardly from their bottom edges toward the apex of said securing member.

8. A container as recited in claim 7 wherein a notch is formed in the bottom edge of said end panels immediately below said weakened tear lines to aid in starting to tear said end panels when opening the container.

* * * * *